US008016127B1

(12) United States Patent
Crump

(10) Patent No.: US 8,016,127 B1
(45) Date of Patent: Sep. 13, 2011

(54) DEVICE FOR STORAGE OF SHOES

(76) Inventor: Stanley G. Crump, Amarillo, TX (US)

( * ) Notice: Subject to any disclaimer, the term of this patent is extended or adjusted under 35 U.S.C. 154(b) by 575 days.

(21) Appl. No.: 12/214,767

(22) Filed: Jun. 23, 2008

(51) Int. Cl.
*A47F 7/08* (2006.01)

(52) U.S. Cl. ..... 211/37

(58) Field of Classification Search ..... 211/34, 211/36, 37, 85.3, 35, 38, 113, 13.1, 189, 211/195, 175, 183; 206/278, 300; 223/85, 223/120

See application file for complete search history.

(56) References Cited

U.S. PATENT DOCUMENTS

| | | | | | |
|---|---|---|---|---|---|
| 752,368 | A * | 2/1904 | Whitcomb | 211/37 |
| 1,270,811 | A * | 7/1918 | Garant | 211/34 |
| 1,567,038 | A * | 12/1925 | Cavanna | 12/53.7 |
| 1,977,157 | A * | 10/1934 | Strobel | 12/123 |
| 2,195,919 | A * | 4/1940 | Crilly et al. | 211/35 |
| 2,284,552 | A * | 5/1942 | Arenz | 211/35 |
| 2,412,847 | A * | 12/1946 | Van Tilburg | 211/35 |
| 2,564,117 | A * | 8/1951 | Lebovits | 12/53.7 |
| 2,586,665 | A * | 2/1952 | Konikoff | 211/37 |
| 2,965,237 | A * | 12/1960 | Wilby | 211/35 |
| 3,292,794 | A * | 12/1966 | Lowe | 211/34 |
| 3,412,866 | A * | 11/1968 | Binding | 294/162 |
| 3,414,093 | A * | 12/1968 | Chostner | 190/16 |
| 3,635,353 | A * | 1/1972 | Matsubara | 211/34 |
| 4,109,335 | A * | 8/1978 | Randolph | 12/123 |
| 4,269,337 | A * | 5/1981 | Sobotka | 294/163 |
| 5,114,017 | A | 5/1992 | Doyel | |
| 5,617,959 | A | 4/1997 | Klein et al. | |
| 5,785,185 | A | 7/1998 | Klebba | |
| 5,855,279 | A | 1/1999 | Klein et al. | |
| 5,992,647 | A | 11/1999 | Malik | |
| 6,266,837 | B1 | 7/2001 | Nord | |
| 6,634,687 | B1 * | 10/2003 | Hayes | 294/143 |
| 2004/0159619 | A1 * | 8/2004 | Klein et al. | 211/35 |

* cited by examiner

*Primary Examiner* — Jennifer E. Novosad
(74) *Attorney, Agent, or Firm* — Norman B. Rainer

(57) ABSTRACT

A shoe storage device adapted for deployment upon a horizontal support surface has upper and lower elongated insert members positioned one above the other in vertical alignment for securing a pair of shoes. The upper shoe is held upside down and both shoes point in opposite directions.

2 Claims, 3 Drawing Sheets

DEVICE FOR STORAGE OF SHOES

BACKGROUND OF THE INVENTION

1. Field of the Invention

This invention relates to the organized storage of pairs of shoes, and more particularly concerns a device for storing pairs of shoes in over and under relationship upon a horizontal support surface.

2. Description of the Prior Art

Most people own multiple pairs of shoes which are generally stored in a closet. An orderly storage arrangement is desirable so that the shoes are maintained in matched pairs in a manner to occupy minimal space.

Shoe storage devices for use in clothing closets have earlier been disclosed for storing the shoes in either vertical or horizontal arrays. Vertical storage devices are usually comprised of a series of pockets or hook-like members supported by either the walls of the closet, the interior surface of the door of the closet, or hanger means releasably supported by a clothes hanging bar disposed horizontally at about shoulder height.

Devices for the storage of shoes in horizontal array are usually designed to rest upon the floor of the closet or upon a shelf located closely above the floor. From the standpoint of efficient utilization of closet space, horizontal shoe storage appears preferable, especially when it employs the otherwise unused floor of the closet.

U.S. Pat. No. 5,114,017 discloses a shoe organizer for organizing shoes in stacked, over-and-under pairs along a horizontal shelf or one or more pairs vertically in string-like fashion. The shoe organizer comprises first and second shoe holders which can function as shoe trees, each having a heel piece and a toe piece, a cross bridge connected to the shoe holders, and first and second hook-retaining formed holes on opposite ends of the shoe organizer for attachment of a plurality of shoe organizers to each other in string-like fashion. Vertical stringing of a plurality of shoe organizers is accomplished by inserting one end of a double ended hook into a formed hole of one shoe organizer and inserting the second end of the double-sided hook into a formed hole of a second shoe organizer. The top-most hook end may be hooked over a closet hanger rod or the like.

U.S. Pat. No. 6,266,837 discloses a combined shoe tree and organizer comprising a two-shoe tree capable of holding and preserving a pair of shoes and an organizer therefor. The two-shoe tree comprises a mounting portion and two heel members, each heel member being connected to said mounting portion by an expandable stretcher bar and is designed to hold and preserve two (i.e. a pair of) shoes as a single unit. The two-shoe tree is provided with an aperture such that it can be integrated or combined with an organizer having a plurality of post members. In this manner, the shoe tree can be detachably secured to the organizer by mounting said aperture over one of the post members. The organizer may be in the form of a single rod which can retain a plurality of two-shoe trees or may be in the form of multiple rods in a grid frame arrangement to form a rack. The organizer can have either a horizontal orientation, for placement on a flat surface, or a vertical orientation for hanging from a door or mounting to a wall.

Said earlier devices, although adequately functional, are of complex, expensive construction. Furthermore, from the standpoint of marketing considerations, said devices occupy considerable space when being shipped to a customer or retail store, and require considerable space in store warehousing and display.

It is accordingly an object of the present invention to provide a device for horizontal deployment for storing pairs of shoes in an over and under configuration.

It is another object of this invention to provide a shoe storage device of the aforesaid nature of simple, durable construction amenable to low cost manufacture.

It is another object of the present invention to provide a device as in the foregoing object which can be folded to a compact size for shipping or storage purposes.

These objects and other objects and advantages of the invention will be apparent from the following description.

SUMMARY OF THE INVENTION

The above and other beneficial objects and advantages are accomplished in accordance with the present invention by a shoe storage device adapted for deployment upon a horizontal support surface, said device comprised of upper and lower elongated insert members positioned one above the other in vertical alignment, each extending horizontally between an unfettered toe extremity and a supported heel extremity, said toe extremities being oppositely directed, vertically oriented support portions associated with each heel extremity, and a connecting member extending laterally in joinder with said support portions in vertical alignment with said insert members and centered therebetween, the configuration of said component members causing said device to have substantially an S shape with a centered vertical plane of symmetry. In a preferred embodiment, said toe extremities are enlarged with respect to the associated heel extremities, said enlargement being in a direction orthogonal to said plane of symmetry.

In a further preferred embodiment, said device is comprised of identical vertically oriented paired side members of rigid monolithic construction spaced apart by 2 to 3 inches and each comprised of upper and lower structural elements in coplanar alignment elongated between toe and heel extremities and spaced apart by support portions which are formed by a bending operation and are joined by a connecting member centered between said upper and lower elements, the toe extremities of said structural elements being interconnected in side by side relationship by horizontally oriented joining means.

In a further preferred embodiment, said side members pivotably engage said joining means to enable the paired side members to be folded to a storage state wherein said side members lie one atop the other in substantially contacting relationship.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
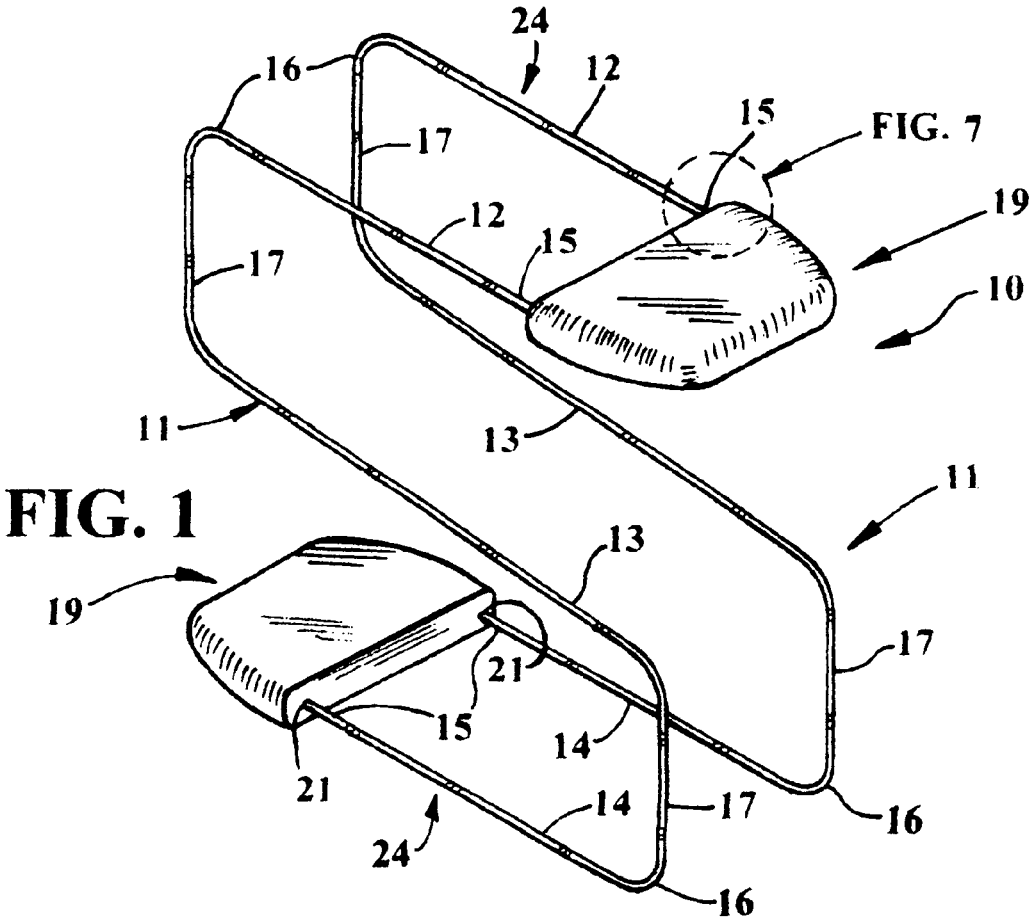
FIG. 1 is a side and top perspective view of a first embodiment of the shoe storage device of the present invention.
Figure 2:
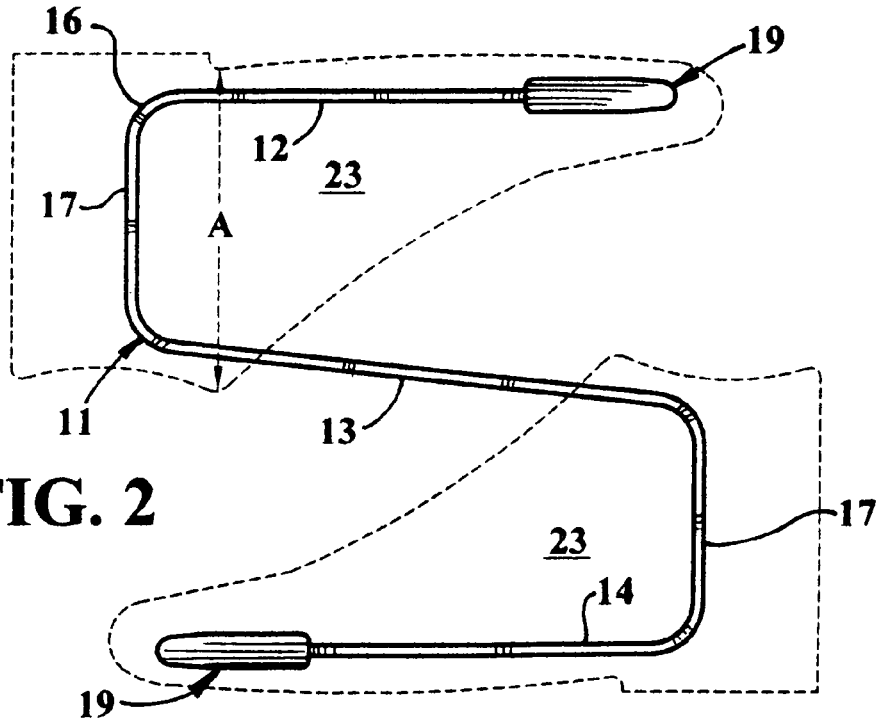
FIG. 2 is a side view of the embodiment of FIG. 1; and shows in phantom outline shoes accommodated by the device.
Figure 3:
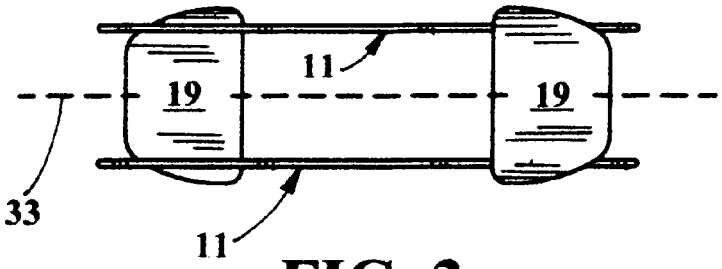
FIG. 3 is a top view of the embodiment of FIG. 1.
Figure 4:
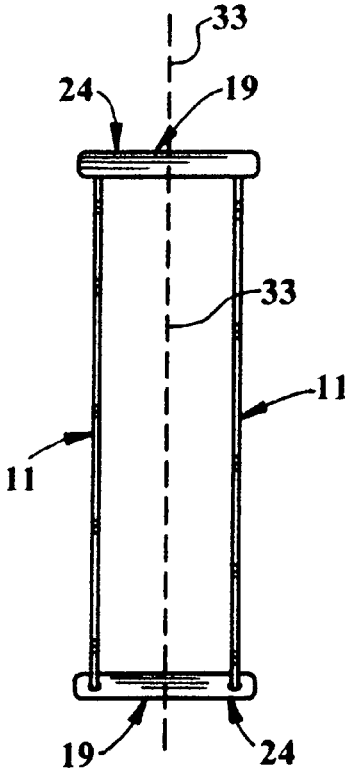
FIG. 4 is a front view of the embodiment of FIG. 1.

Referring now to FIGS. 1-5, a first embodiment of the shoe storage device 10 of this invention is shown comprised of identical paired side members 11 of rigid monolithic construction spaced apart by about 2-3 inches in vertical orientation, each comprised of upper and lower structural elements 12 and 14, respectively, and connecting member 13. Said structural elements are elongated between toe and heel extremities 15 and 16, respectively, and are spaced apart in vertically coplanar alignment by support portions 17 integral with said structural elements at said heel extremities and having been formed by a bending operation. Each support portion 17 is joined by connecting member 13 as a continuous integral extension thereof.

The toe extremities of the structural elements of opposing side members 11 are interconnected by horizontally oriented joining means 19. Said joining means 19 cause members 11 to be spaced apart by 2-3 inches in parallel juxtaposition, and in combination produce upper and lower insert members 24 adapted to enter and retain a shoe. Said insert members, measured from toe to heel extremities have a length preferably between 7 and 8 inches. For example, a length of 7⅜ inches allows the device to accommodate children's sizes through large men's sizes. The associated support portions 17 must be long enough to accommodate the height of the shoe instep, shown as distance A in FIG. 2. The assembled device 10 has a centered vertical plane of symmetry 33.

Figure 5:
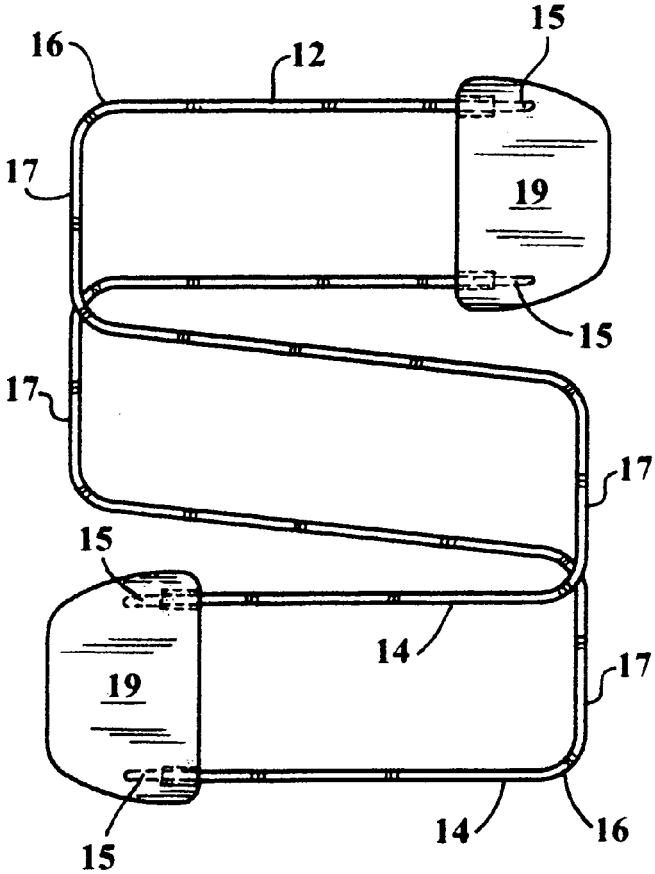
FIG. 5 is a top view showing the device of FIG. 1 in its compacted, storage state.

In said first embodiment, side members 11 are separate pieces of metal rod stock of circular cross-sectional contour which have been bent to produce the aforesaid configuration. The toe extremities of the upper and lower structural elements are straight ends and are caused to enter matching bores 21 in the associated joining means, causing tight-fitting interengagement therewith but allowing rotative movement of such joinder. The effect of such interaction of components is to allow the device to be compacted to a flattened storage state, as shown in FIG. 5.

Figure 7:
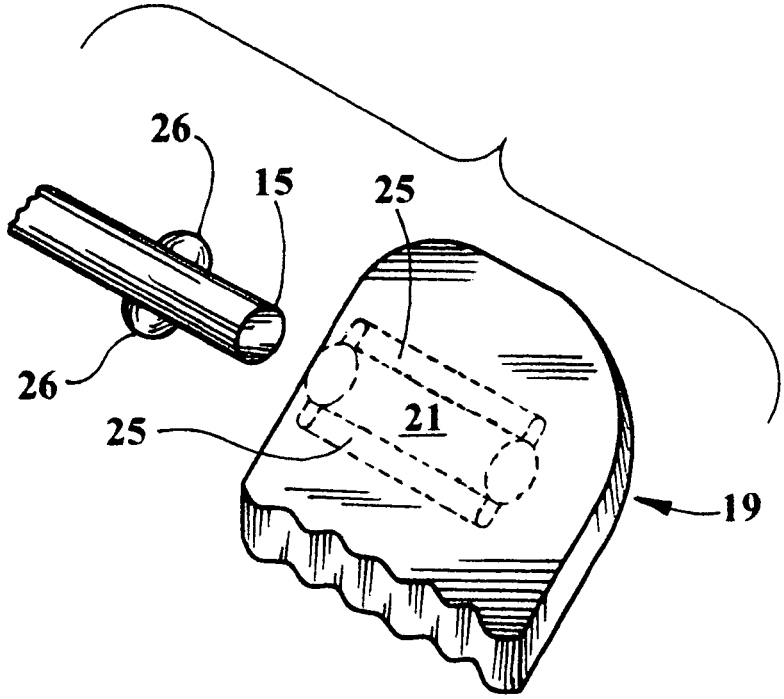
FIG. 7 is an enlarged, exploded view of the encircled region denoted in FIG. 1.

Said storage state facilitates shipment of a multitude of the devices in a single, relatively compact package, and minimizes display space requirements in a retail store. Although said storage state is achieved by rotative movement of the extremities of the rod stock with respect to the associated joining means, it is necessary that such movement be prevented when the device is employed for the retention of a pair of shoes. To achieve such objective, locking means are preferably incorporated into said toe extremities and associated joining means. One embodiment of such locking means is exemplified in FIG. 7, wherein bore 21 of joining means 19 is shown to communicate with opposed slots 25. Tabs 26, outwardly protruding from said structural elements adjacent toe extremities 15, are configured and positioned in a manner to slidably insert into slots 25. The locked state is achieved by lifting joining means 19, which causes extremity 15 to rotate within bore 21 to an extent which produces alignment of tabs 26 with slots 25, then pushing said joining means further onto said structural elements. Joining means 19 preferably has a lateral size which extends beyond the spaced apart separation of side members 11.

Tabs 26 are preferably formed by a hot stamping operation applied to said metal rod stock, which produces tabs that are continuous integral extensions of the rod stock. In alternative embodiments, said locking means may be comprised of alignable penetrating apertures orthogonally positioned with respect to the axes of extremity 15 and bore 21, and a locking pin insertable through said aligned apertures. When deployed for use in accommodating a pair of shoes 23, said joining means 19 are caused to enter a received shoe and extend toward the toe extremity thereof.

The first embodiment of the device, illustrated in FIGS. 1-5, may be in a kit form which further facilitates compact storage for shipping and marketing purposes. The kit contains separate side members 11 and joining means 19, and a supply of adhesive or other means for achieving the assembly and securement or locking of said components.

Figure 6:
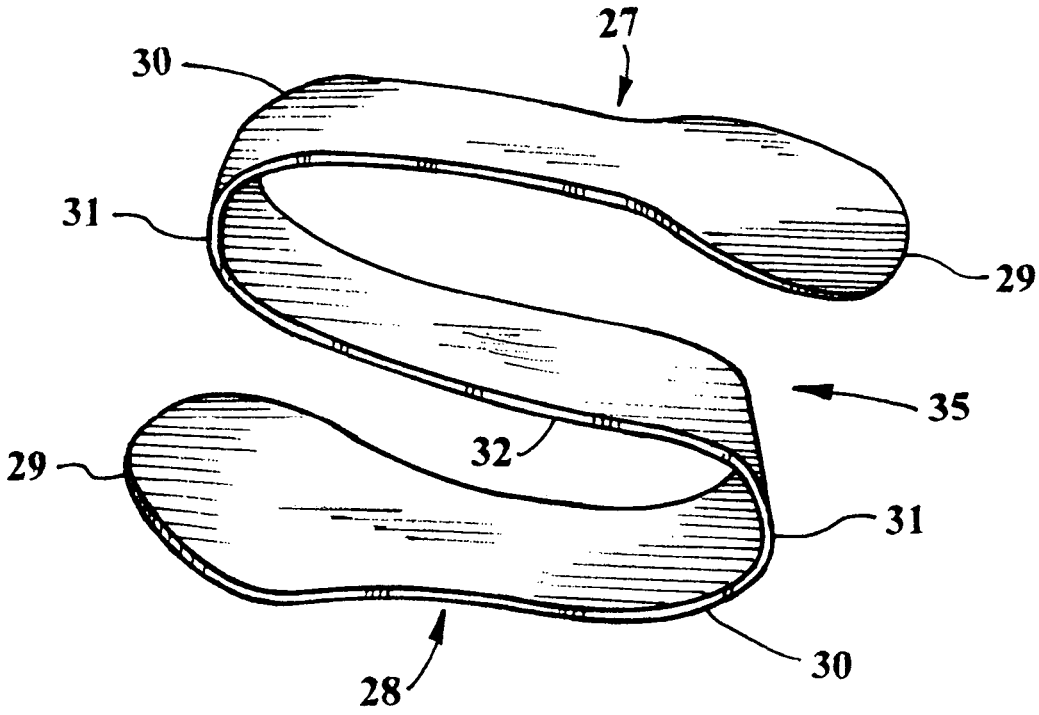
FIG. 6 is a side and top perspective view of a second embodiment of the shoe storage device of the present invention.

In a second embodiment of the present invention, as shown in FIG. 6, the shoe storage device is of monolithic construction having upper and lower elongated insert members 27 and 28, respectively, having identical widths of 2-3 inches and positioned one above the others in vertical alignment and centered upon said plane of symmetry. Each insert member extends horizontally between an unfettered toe extremity 29 and a supported heel extremity 30. Said toe extremities are oppositely directed. Vertically oriented support portions 31 are associated with each heel extremity. A connecting member 32 extends laterally in joinder with said support portions in vertical alignment with said insert members and centered therebetween. Said second embodiment may be fabricated of properly bent wood, metal, plastic or bamboo.

The configuration of the components of said first and second embodiments causes said device to have a substantially S shape with a vertically centered plane of symmetry 33. The unfettered toe extremities 29 are preferably enlarged with respect to the associated heel extremities, said enlargement being in a direction orthogonal to said plane of symmetry and serving the purpose of providing a more stable grip on a shoe when said toe extremity is inserted into a shoe and forced into the toe portion thereof. The device is preferably sufficiently resilient to permit a controlled degree of downward bending under the weight of an uppermost heavy shoe. Such feature produces a lowered center of gravity, and causes the shoe-containing device to occupy less vertical space.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A shoe storage device adapted for deployment in an erected state upon a horizontal support surface, said device comprised of upper and lower elongated insert members positionable one above the other in vertical alignment and extending horizontally between an unfettered toe extremity and a supported heel extremity, and a connecting member extending laterally between said heel extremities in vertical alignment with said insert members, said device having, in erected state, an S shape with a centered vertical plane of symmetry, and constructed of paired identical side members of monolithic construction having upper and lower structural elements terminating in straight toe ends having locking means, said side members being spaced apart by 2-3 inches in parallel association by joining means having apertures which receive said locking means, thereby permitting movement of said device between a compacted state and said erected state without disassembly.

2. The storage device of claim 1 wherein said locking means stabilize said device in said erected state.

* * * * *